US011109704B2

(12) United States Patent
Mandich

(10) Patent No.: US 11,109,704 B2
(45) Date of Patent: Sep. 7, 2021

(54) BABY ACCESSORY STORAGE ASSEMBLY

(71) Applicant: Kiki Business Ventures, LLC, Miami, FL (US)

(72) Inventor: Christina Hand Mandich, Miami, FL (US)

(73) Assignee: KIKI Business Ventures, LLC, Miami, FL (US)

( * ) Notice: Subject to any disclaimer, the term of this patent is extended or adjusted under 35 U.S.C. 154(b) by 0 days.

(21) Appl. No.: 16/640,054

(22) PCT Filed: Nov. 11, 2019

(86) PCT No.: PCT/US2019/060682
§ 371 (c)(1),
(2) Date: Feb. 18, 2020

(87) PCT Pub. No.: WO2020/097599
PCT Pub. Date: May 14, 2020

(65) Prior Publication Data

US 2021/0085114 A1 Mar. 25, 2021

Related U.S. Application Data

(60) Provisional application No. 62/758,513, filed on Nov. 9, 2018.

(51) Int. Cl.
*A47G 29/093* (2006.01)
*A47D 5/00* (2006.01)

(52) U.S. Cl.
CPC ..... *A47G 29/093* (2013.01); *A47D 5/00* (2013.01)

(58) Field of Classification Search
CPC ..... A47G 29/093; A47D 5/00; B65F 1/1415; B65F 2210/18; F16B 2/245; A47B 46/00; B65D 25/06
USPC ..... 248/229.12, 229.22, 229.13, 229.23, 248/227.2, 228.3, 228.5, 231.21, 231.41, 248/231.51, 231.61, 229.2, 229.21, 248/229.25, 229.26, 211, 238, 210, 236,
(Continued)

(56) References Cited

U.S. PATENT DOCUMENTS 1,653,246 A 12/1927 Zichy
1,676,012 A * 7/1928 Fascetta ..... A45D 27/46 132/314

(Continued)

*Primary Examiner* — Kimberly T Wood
(74) *Attorney, Agent, or Firm* — Mark C. Johnson; Johnson Dalal

(57) ABSTRACT

A baby accessory storage assembly comprising a portable body with a bottom wall and a sidewall surrounding the bottom wall, wherein the bottom wall and sidewall define a storage cavity. The storage assembly has one or more partition walls within the storage cavity defining a plurality of sub-storage cavities for customized storage. Further, at least two hinged clamping assemblies, each rotatably coupled to the sidewall and disposed at the rear end of the body, are operably configured to selectively adjust, through use of a fastener, a width therein between, so as to effectively clamp and attach the storage assembly to a variety of different structures. The clamp assemblies are operable to rotate to allow the clamp assemblies to lock into one of two different positions. The assembly may also include a pull-out table, additional storage compartments, and elastic bands on the inner and outer surfaces of the portable body.

18 Claims, 6 Drawing Sheets

(58) Field of Classification Search
USPC ..... 248/689, 691, 640, 642, 653; 220/529, 220/532, 533, 545, 23.8, 23.83, 23.86, 220/475, 476, 477, 478, 479, 480, 481, 220/482, 483; 206/581; 312/290, 249.3, 312/249.4, 280, 282; 383/33
See application file for complete search history.

(56) References Cited

U.S. PATENT DOCUMENTS

| | | | | | |
|---|---|---|---|---|---|
| 2,187,059 | A * | 1/1940 | Schor | A47J 45/02 | 248/188.1 |
| 2,521,572 | A * | 9/1950 | Eckel | A47B 67/02 | 312/243 |
| 2,726,837 | A * | 12/1955 | Jameson | A63F 3/06 | 248/231.71 |
| 2,911,133 | A * | 11/1959 | Ruggieri | E06C 7/14 | 182/129 |
| 4,212,377 | A * | 7/1980 | Weinreb | A45C 13/02 | 190/109 |
| 4,466,146 | A | 8/1984 | Regan | | |
| 4,955,677 | A * | 9/1990 | Song | A47F 7/146 | 211/128.1 |
| 5,299,336 | A | 4/1994 | Marteeny | | |
| 5,547,080 | A * | 8/1996 | Klimas | B25H 3/02 | 182/129 |
| 5,584,412 | A * | 12/1996 | Wang | B65D 25/04 | 220/500 |
| 5,639,052 | A * | 6/1997 | Sauve | B60N 3/103 | 248/311.2 |
| 5,813,642 | A * | 9/1998 | Warren | E04H 13/003 | 248/229.15 |
| 6,213,268 | B1 * | 4/2001 | Dancyger | A45C 13/02 | 150/113 |
| 6,224,152 | B1 | 5/2001 | Hughes et al. | | |
| 6,694,552 | B1 | 2/2004 | Vickers | | |
| 6,959,811 | B1 * | 11/2005 | Hoover | A01K 97/06 | 206/315.11 |
| 7,021,825 | B1 | 4/2006 | Schultz | | |
| 7,044,424 | B2 * | 5/2006 | Robertson | A47F 3/0439 | 206/561 |
| 8,973,757 | B2 | 3/2015 | Fimbrez | | |
| 8,977,534 | B2 | 3/2015 | Narutani et al. | | |
| 9,301,623 | B2 | 4/2016 | Herdman | | |
| 9,981,778 | B2 * | 5/2018 | Plattner | B65D 25/06 | |
| 2006/0070901 | A1 * | 4/2006 | Adams | B25H 3/00 | 206/373 |
| 2007/0122066 | A1 | 5/2007 | Landay | | |
| 2007/0152002 | A1 * | 7/2007 | Dollar, Jr. | B60R 11/00 | 224/404 |
| 2009/0008521 | A1 * | 1/2009 | Lee | F16M 13/022 | 248/226.11 |
| 2009/0014622 | A1 * | 1/2009 | Merritt | A47G 23/0225 | 248/689 |
| 2011/0283455 | A1 | 11/2011 | Grainger | | |
| 2012/0096647 | A1 | 4/2012 | Presnell et al. | | |
| 2012/0189230 | A1 * | 7/2012 | King | B65F 1/1415 | 383/33 |
| 2014/0110544 | A1 * | 4/2014 | Chang | F16M 11/28 | 248/207 |
| 2014/0203033 | A1 * | 7/2014 | Schmidt | B65F 1/141 | 220/737 |
| 2016/0176577 | A1 * | 6/2016 | Frankenberg | B65D 1/22 | 220/533 |
| 2017/0303701 | A1 | 10/2017 | Degon et al. | | |
| 2018/0362212 | A1 * | 12/2018 | Bahr | B65D 25/06 | |
| 2021/0061554 | A1 * | 3/2021 | Moore | F16M 13/02 | |

* cited by examiner

100

BABY ACCESSORY STORAGE ASSEMBLY

CROSS-REFERENCE TO RELATED APPLICATION

This application is a national stage filing of International Application Number PCT/US2019/060682, filed Nov. 11, 2019, which claims priority to U.S. Provisional Patent Application No. 62/758,513, filed Nov. 9, 2018, the entirety of which is incorporated by reference.

FIELD OF THE INVENTION

The present invention relates generally to storage assemblies for personal items, and, more particularly, relates to portable baby accessory storage assemblies.

BACKGROUND OF THE INVENTION

As many parents know, changing a baby's diaper can get messy very quickly and you need to have all of your products easily accessible to make the time your baby spends on the changing table as enjoyable and efficient as possible. Many changing tables available today do not include a place to hold all of the accessories needed for diaper hygiene that are within easy reach while changing a baby's diaper. Alternatives for consumers today include purchasing a separate table for storage or installing a wall shelf which are expensive and time-consuming options.

Some known devices employed to store and/or organize baby accessories, clothing or other personal items also include handheld and portable containers that are required to be placed on a surface or containers having one or more hooks thereon. The handheld and portable containers that are required to be placed on a surface are problematic as they take up space that could be used for the child. The handheld and portable containers that utilize hook(s) are problematic as they limit the orientation and placement of the container and often place the container in a position that is not easy to access by the user or do not fit well on the changing table because there is no way to customize the attachment.

Therefore, a need exists to overcome the problems with the prior art as discussed above.

SUMMARY OF THE INVENTION

The invention provides a baby accessory storage assembly that overcomes the hereinafore-mentioned disadvantages of the heretofore-known devices and methods of this general type and that is designed to hold accessories like diaper wipes, diaper cream, combs, thermometers, lotions and other items related to changing a baby's diaper and general hygiene. Therefore, unlike known devices designed to hold baby accessories, the present invention is universal and can adapt to many different surfaces and structures in a safe, effective and efficient manner. It easily attaches to any changing table tray with two clamp assemblies, so the attachment mechanism adjusts to the size needed for any changing table tray or other structure. The benefit of the clamp assemblies on this product is that they can rotate to attach to various surfaces at different angles. The clamp assemblies can alternate between an upright locked position, whereby the clamp members can be attached to any outwardly protruding structures, such as changing tables, and a downright locked position, achieved upon transitioning the clamp assemblies 90 degrees downward, whereby the clamp members can be attached to any other structures like changing tables. The portable body is comprised of a flexible canvas fabric allowing the storage assembly to be collapsed for easy storage and transportation. The storage assembly is further comprised of a storage cavity wherein at least one partition wall within the storage cavity can be customized, removed, and adjusted accordingly to vary the size of the resulting divided storage cavities. These storage cavities, or internal compartments, can then be used to hold various types of baby accessories. Different embodiments of this invention may also include a pull-out table that slides in and out of the bottom wall of the storage assembly provides additional surface area to place dirty diapers, medicine, onesies, etc. Additional storage space is provided by two outer side pockets, two sturdy hooks to hang various other baby accessories, and elastic bands on the inner wall of the storage assembly to conveniently store additional items.

With the foregoing and other objects in view, there is provided, in accordance with the invention, a baby accessory storage assembly comprising a portable body having a front end, a rear end, two opposing sides, a bottom wall, and a sidewall surrounding the bottom wall and having an upper perimeter edge thereon and an inner surface and an outer surface, the bottom wall and sidewall defining a storage cavity. The storage assembly further comprises at least one partition wall disposed within the storage cavity and with opposing ends directly coupled to the inner surface of the sidewall to define a plurality of sub-storage cavities for customized storage. Further, at least two hinged clamping assemblies, each rotatably coupled to the sidewall and disposed at the rear end of the body, are operably configured to selectively adjust, through use of a fastener, a width between the two clamp members comprising each clamp assembly, so as to effectively clamp and attach the storage assembly to a variety of different structures.

In accordance with another feature, an embodiment of the present invention includes the at least two hinged clamping assemblies further comprised of a center wall separating and coupled to the upper and lower clamp members and forming a U-shape.

In accordance with a further feature of the present invention, the upper and lower clamp members are substantially planar.

In accordance with another feature, an embodiment of the present invention also includes a deformably resilient material disposed on an inner surface of at least one of the upper clamp member and the lower clamp member.

In accordance with yet another feature, an embodiment of the present invention includes the clamp translation path 500 is circular.

In accordance with yet another feature, an embodiment of the present invention includes the at least two hinged clamping assemblies further comprising a hinge disposed proximal to the upper perimeter edge of the sidewall.

In accordance with yet another feature, an embodiment of the present invention includes the portable body further comprising an upper body rim of a substantially rigid material surrounding and defining the upper perimeter edge of the sidewall.

In accordance with a further feature of the present invention, the sidewall surrounding the bottom wall is of a flexible cloth material.

In accordance with yet another feature, an embodiment of the present invention includes a pull-out table housed within a bottom wall cavity defined by the bottom wall, the pull-out table operably configured to be selectively extended from and retracted in the bottom wall cavity.

In accordance with yet another feature, an embodiment of the present invention includes the at least one partition wall directly coupled to the inner surface of the sidewall with a selectively removable hook-and-loop configuration.

In accordance with yet another feature, an embodiment of the present invention includes the at least one partition wall being selectively collapsible onto a flat position on the bottom wall and being positioned upright within the storage cavity and locked into place by being fitted within a rectangular groove.

Although the invention is illustrated and described herein as embodied in a Baby Accessory Storage Assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one.

The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the baby accessory storage assembly, spanning from a left end to a right end of the baby accessory storage assembly.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
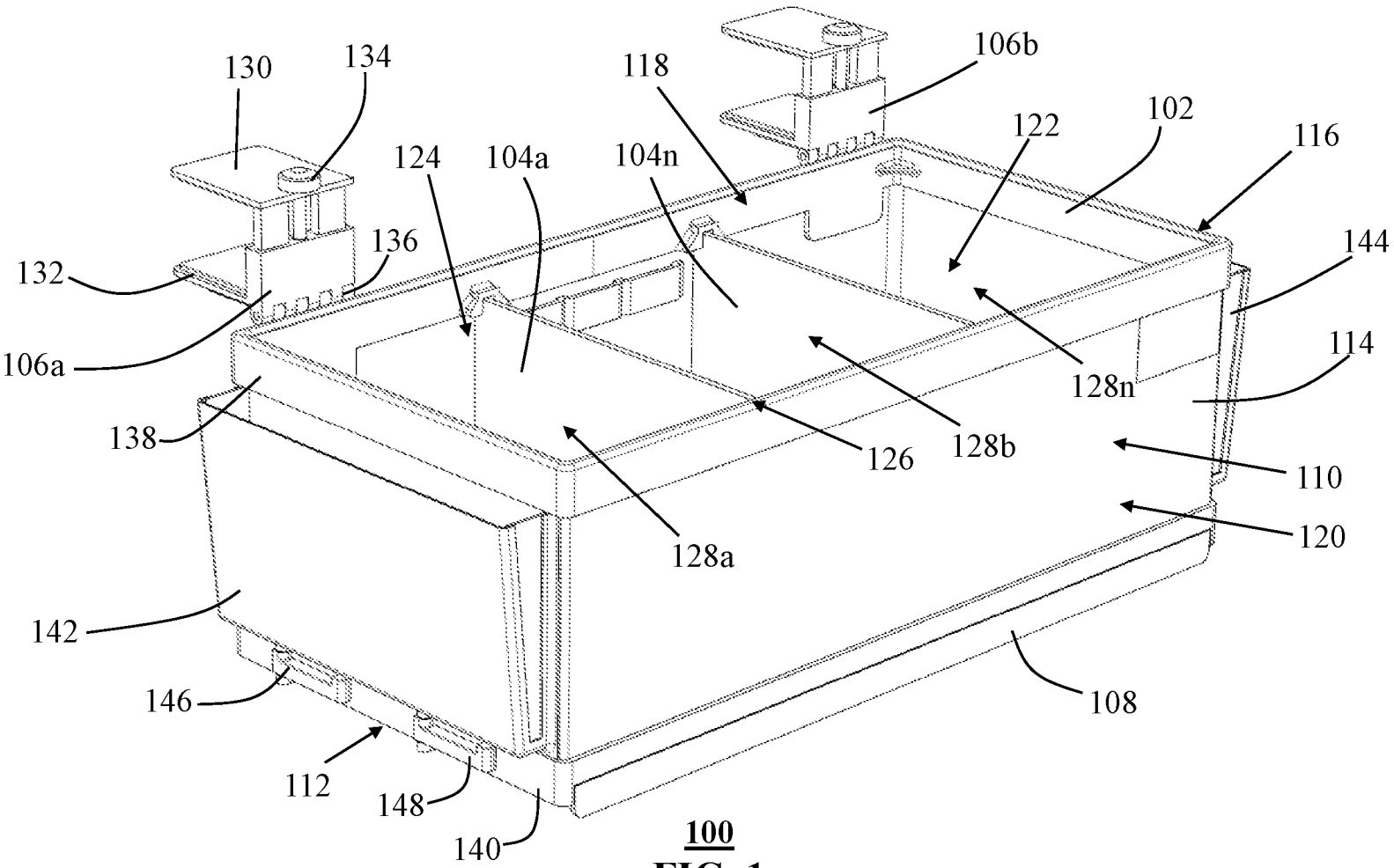
FIG. 1 is a perspective front view of a baby accessory storage assembly in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient portable baby accessory storage assembly that is adapted to selectively, effectively, and safely removably couple to a variety of standing structures, such as to a dresser, changing table, or coffee table, for quick and effective storage, organization, and transportation. Embodiments of the invention provide a collapsible structure wherein users can collapse the storage assembly structure for easier storage or transportation. In addition, embodiments of the invention provide a pull-out table that can be used for additional surface space to place baby accessories such as baby creams, diapers, and onesies.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of a baby accessory storage assembly 100, as shown in FIG. 1, includes a portable body 102, at least one partition wall 104, at least two hinged clamping assemblies 106*a-b*, and a pull-out table 108. The portable body 102 and sidewall 114, which encloses a storage cavity 122, is comprised of a flexible canvas fabric and is operable to be handled, transported, and/or manipulated by the user's hands. To that end, the body is portable in that it is also lightweight, e.g., 0.5-2.5 lbs.

Figure 3:
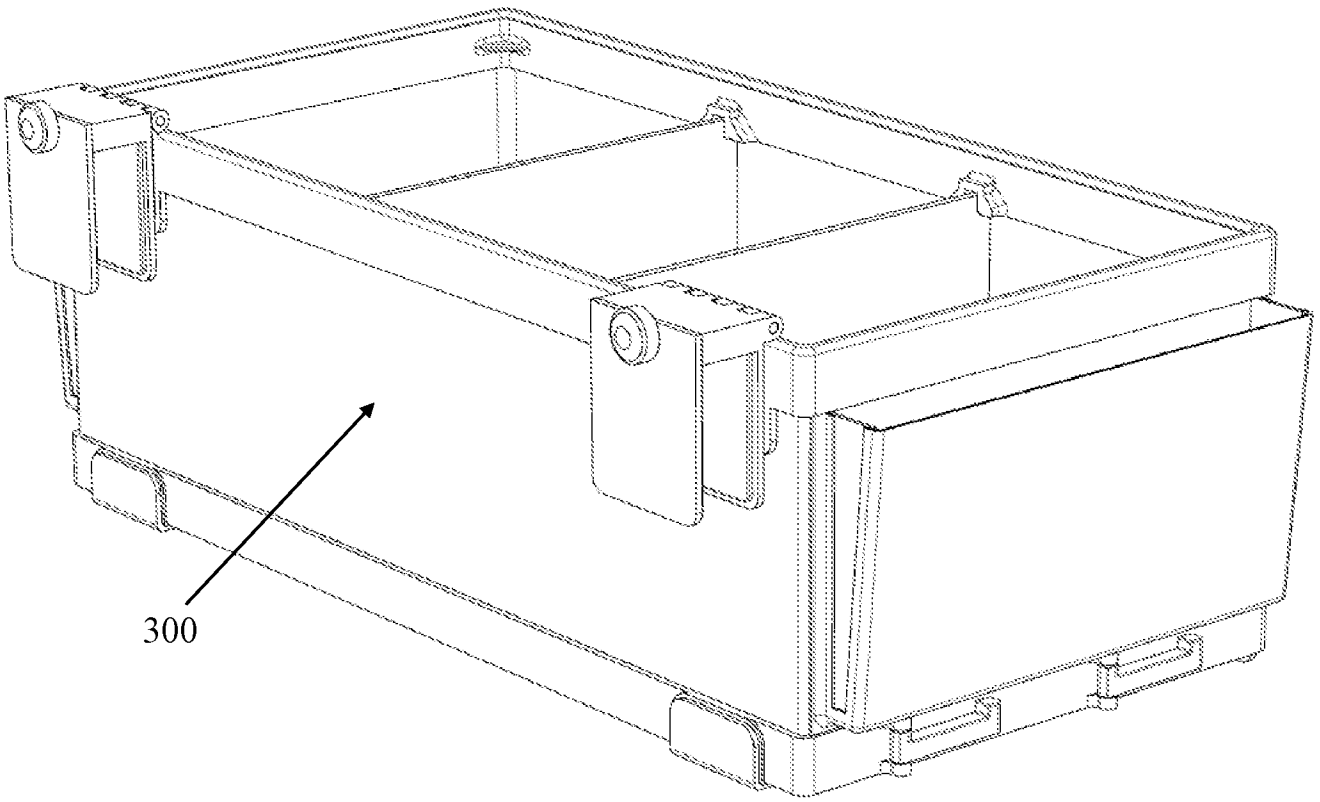
FIG. 3 is a perspective rear view of the baby accessory storage assembly in FIG. 1.

As best seen in FIG. 1 and FIG. 3, the portable body 102 includes a front end 110, a rear end 300, two opposing sides 400, 402, a bottom wall 112, and a sidewall 114 surrounding the bottom wall 112 and having an upper perimeter edge 116 thereon and an inner surface 118 and an outer surface 120, the bottom wall 112 and sidewall 114 defining the storage cavity 122. The upper perimeter edge 116 runs along the entire upper perimeter of the portable body 102 and may be composed of a substantially rigid material. For example, the upper perimeter 116 of the portable body 102 may include a substantially rigid upper rim 138 of a polymeric material, e.g., thermoplastic rubber ("TPR"). In one embodiment of this invention, one or more hinged clamping assemblies 106*a-b* are mechanically coupled to the upper rim 138 and/or the upper perimeter edge 116 defined thereon. In one embodiment, the distance between the front end 110 and rear end 300 is approximately 7-8 inches in length, while the distance between the two opposing sides 400 and 402 is approximately 16-18 inches in length, thereby making the baby accessory storage assembly 100 more portable.

As best seen in FIG. 1 and FIG. 3, the baby accessory storage assembly 100 may include one or more partition walls 104*a-n*, wherein "n" represents any number greater than one. The partition walls 104*a-n* enable customizability of the storage cavity 122, wherein each partition wall 104*a-n* may be selectively removed, customized, and adjusted accordingly, varying the amount of divided space in the storage cavity 122. The partition wall 104*a-n* is disposed within the storage cavity 122 and has opposing ends 124, 126 which are directly coupled to the inner surface 118 of the sidewall 114 to define a plurality of sub-storage cavities 128*a-n*, wherein "n" represents any number greater than one. The partition wall 104*a-n* may also be affixed to the inner surface 118 of the bottom wall 112 by way of a selectively removable hook-and-loop fastener configuration. Other means to selectively couple and uncouple the partition wall 104*a-n* to the sidewall 114 and/or bottom wall 112 are also discussed herein.

Figure 4:
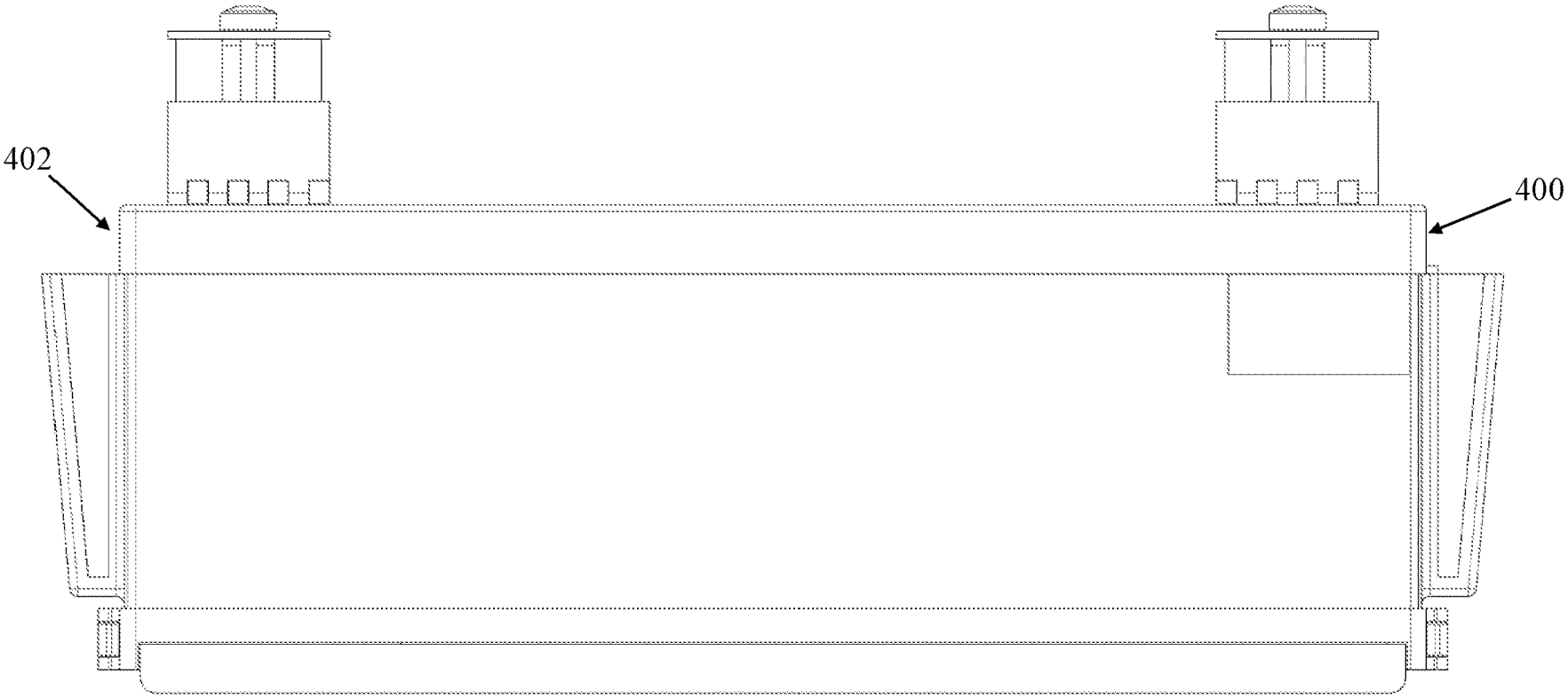
FIG. 4 is an elevational front view of the baby accessory storage assembly in FIG. 1.
Figure 5:
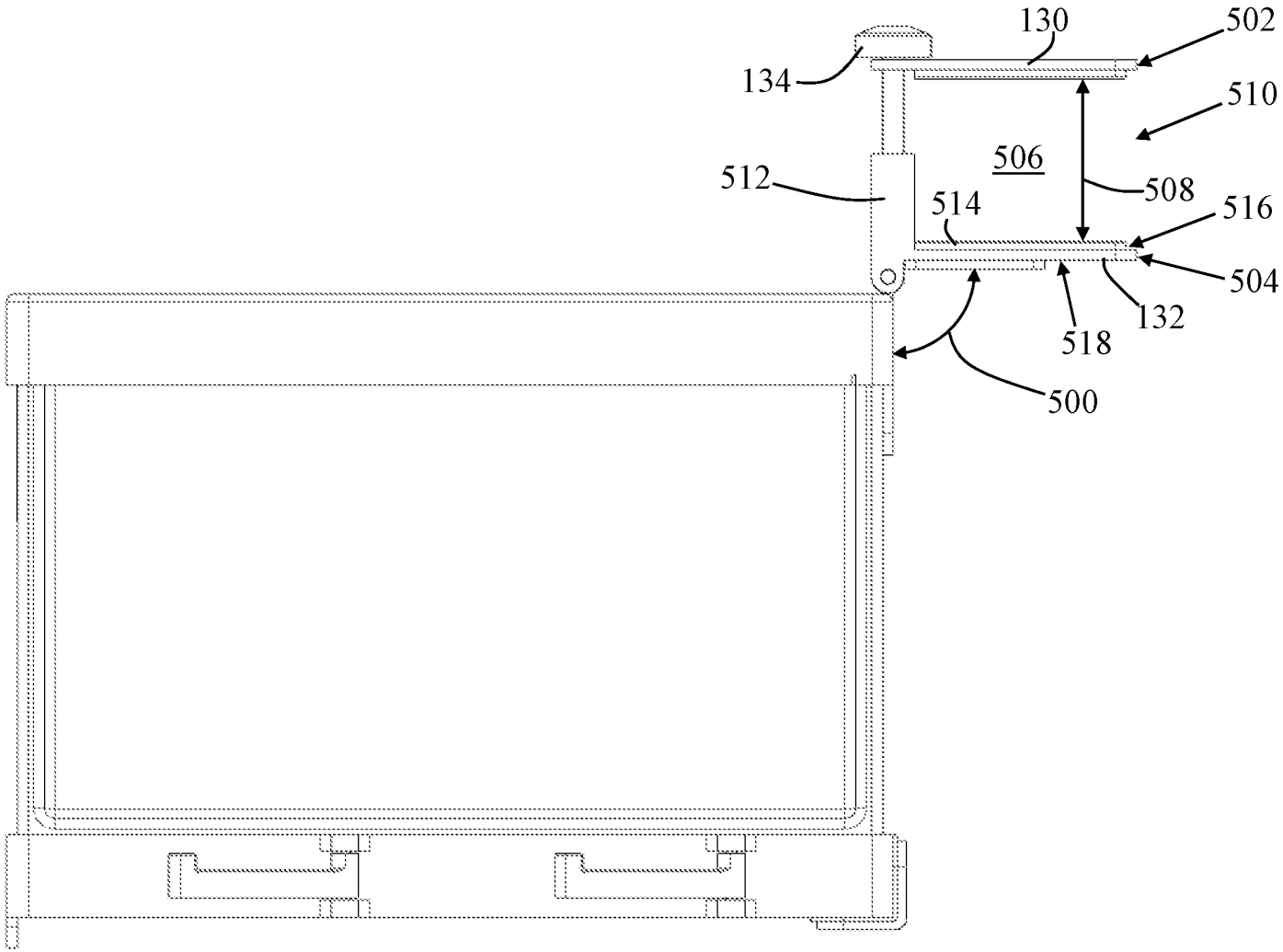
FIG. 5 is an elevational side view of the baby accessory storage assembly in FIG. 1.

As best seen in FIG. 1 and FIGS. 4-5, at least two hinged clamping assemblies 106*a-b* are each rotatably coupled to the sidewall 114, disposed at the rear end 300 of the body 102, and have an upper clamp member 130 with an outer terminal end 502 and a lower clamp member 132 with an outer terminal end 504. The upper and lower clamp members 130, 132 define a width channel 506 therein between. The width is represented by arrow 508 in FIG. 5. Said another way, the clamp members 130, 132 are operably configured to compress and expand to accommodate different size widths of structures, e.g., cantilevered or projecting portions of a baby changing table, coffee table, door, etc.

The clamp members 130, 132 are further operably configured to selectively adjust the width 508 of the width channel 506 through use of a fastener 134. Compression and expansion of the clamp members 130, 132 is achieved through manipulation of the fastener 134, disposed on the upper clamp 130, on the end opposite that of the outer terminal end 502. Manipulation of the fastener 134 has the effect of adjusting the width 508 of the width channel 506 to fit the width of the structure to which the portable body 102 will be attached. The clamp members 130, 132 define a width opening 510 with the outer terminal ends 502, 504 of the upper and lower clamp members 130, 132, respectively. Movement of one or both of the clamp members 130, 132 (or components coupled thereto) compress and/or frictionally retain the width of the structure inserted within the width 508 of the width channel 506.

As best seen in FIG. 1 and FIGS. 4-5, the at least two hinged clamping assemblies 106*a-b* have a first locked position along a clamp translation path 500, represented with arrow 500 in FIG. 5, with the width opening 510 oriented in a direction facing away from the rear end 300 of the portable body 102. In one embodiment, the clamp translation path 500 is circular. In other embodiments, the clamp translation path 500 is linear or curvilinear. In one embodiment, the hinged clamping assemblies 106*a-b* may be locked using a friction-inducing hinge, while in other embodiments the hinged clamping assemblies 106*a-b* may be locked in a position along the clamp translation path 500 using a fastener or through a tongue-and-groove configuration. The hinged clamping assemblies 106*a-b* are "locked," in that they are unable to move along the clamp translation path 500 without user manipulation and/or applying a desired amount of force, e.g., 5-10 lbf.

Figure 2:
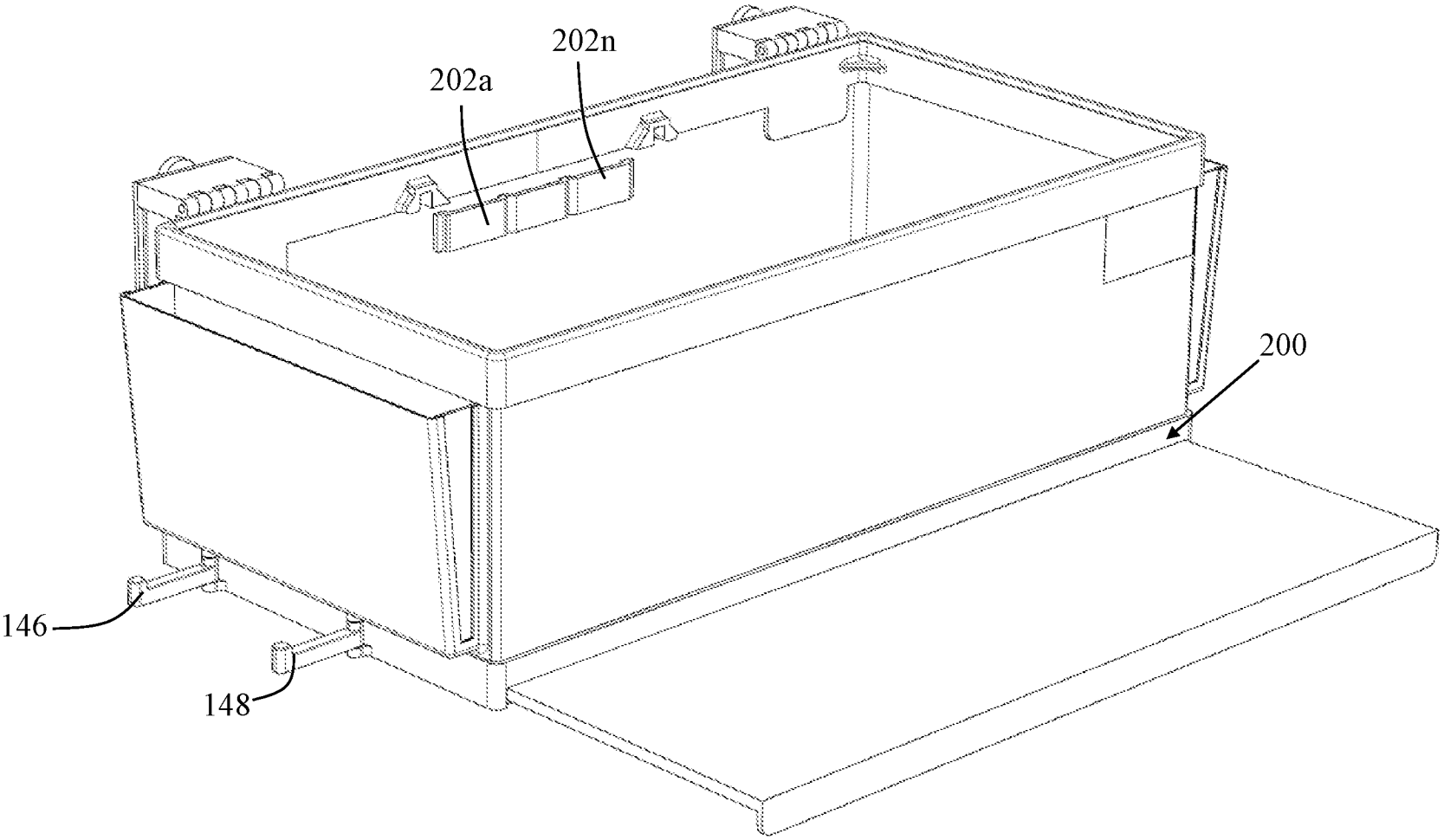
FIG. 2 is a perspective front view of the baby accessory storage assembly in FIG. 1, with a table selectively extended thereon and with the structure connectors in another coupling position in accordance with one embodiment of the present invention.

As best seen in FIGS. 2-3, the at least two hinged assemblies 106*a-b* have a second locked position along the clamp translation path 500 with the width opening 510 oriented in a direction facing downward and approximately 90° with respect to the width opening 510 when in the first locked position. As such, the body 102 of the baby accessory storage assembly 100 is operably configured to be positioned, accessible, and oriented in various positions beneficial to many users.

The at least two hinged clamping assemblies 106*a-b* may also include a center wall 512 separating and coupled to the upper and lower clamp members 130, 132. The center wall 512 and upper and lower clamp members 130, 132 have inner surfaces defining the width channel 506 and form a U-shape that enables easy insertion and removal of the cantilevered or projecting portions of a baby changing table, coffee table, door, etc. The upper and lower clamp members 130, 132 may also be beneficially substantially planar, wherein "substantially planar" is defined as being of a substantially flat width that is no more than approximately 0.5 inches wide. This width enables coupling of the body to a structure while minimizing the space taken up by the one or more hinged clamping assemblies 106*a-b*.

As best seen in FIG. 5, one possible configuration of this invention further comprises a deformably resilient material 514 disposed on an inner surface 516 of at least one of the upper clamp member 130 and the lower clamp member 132. The deformably resilient material 514 provides a buffer or cushion when at least one of the upper clamp member 130 and the lower clamp member 132 compress and clamp onto a structure. The outer surface 518 of the lower clamp member 132 of each of the hinged clamping assemblies 106*a-b* may also include the deformably resilient material 514 disposed thereon to prevent damage to the body 102 when the hinged clamping assemblies 106*a-b* are in the second locked position along the clamp translation path 500.

In another embodiment of this invention, the clamp translation path 500 is circular, wherein the at least two hinged clamping assemblies 106*a-b* rotate radially around a central axis of a hinge 136 and lock into position at any one point on the circumferential length defined by the central axis.

In different embodiments of this invention, the center wall 512 is further coupled to an upper body rim 138 of a substantially rigid material, e.g., acrylonitrile butadiene styrene ("ABS"). The upper body rim 138 can be seen surrounding and defining the upper perimeter edge 116 of the sidewall 114.

The at least two hinged clamping assemblies 106*a-b* may further comprise the hinge 136 disposed proximal to the upper perimeter edge 116 of the sidewall 114, wherein "proximal" is defined as at the edge or within approximately 1-2 inches.

The portable body 102 may also include a lower body rim 140, also of a substantially rigid material, coupled to the sidewall 114 and disposed proximal to the bottom wall 112 and opposite the upper body rim 138. Separating the upper and lower body rims 138, 140 may include a sidewall material that is of a flexible canvas or cloth material, enabling the assembly 100 to be easily collapsible and manipulated to facilitate storage or transportation of the assembly 100 when not desired for use.

In one embodiment, the assembly 100 may also include a pull-out table 108 housed within a bottom wall cavity 200 defined by the bottom wall 112. The pull-out table 108 is operably configured to be selectively extended from and retracted in the bottom wall cavity 200. The bottom wall 112 includes a solid upper ceiling that maintains support of the accessories stored within the storage cavity 122 when the pull-out table 108 is extended outward and away from the bottom wall cavity 200. The bottom wall 112 may also include a solid lower floor as well, wherein the solid upper ceiling and the solid lower floor define the bottom wall cavity 200. The pull-out table 108 beneficially enables users to place baby accessories, dirty diapers, clothing, etc., thereon while, for example, changing a child. As such, the pull-out table 108 is not designed to support the weight of a child.

Figure 6:
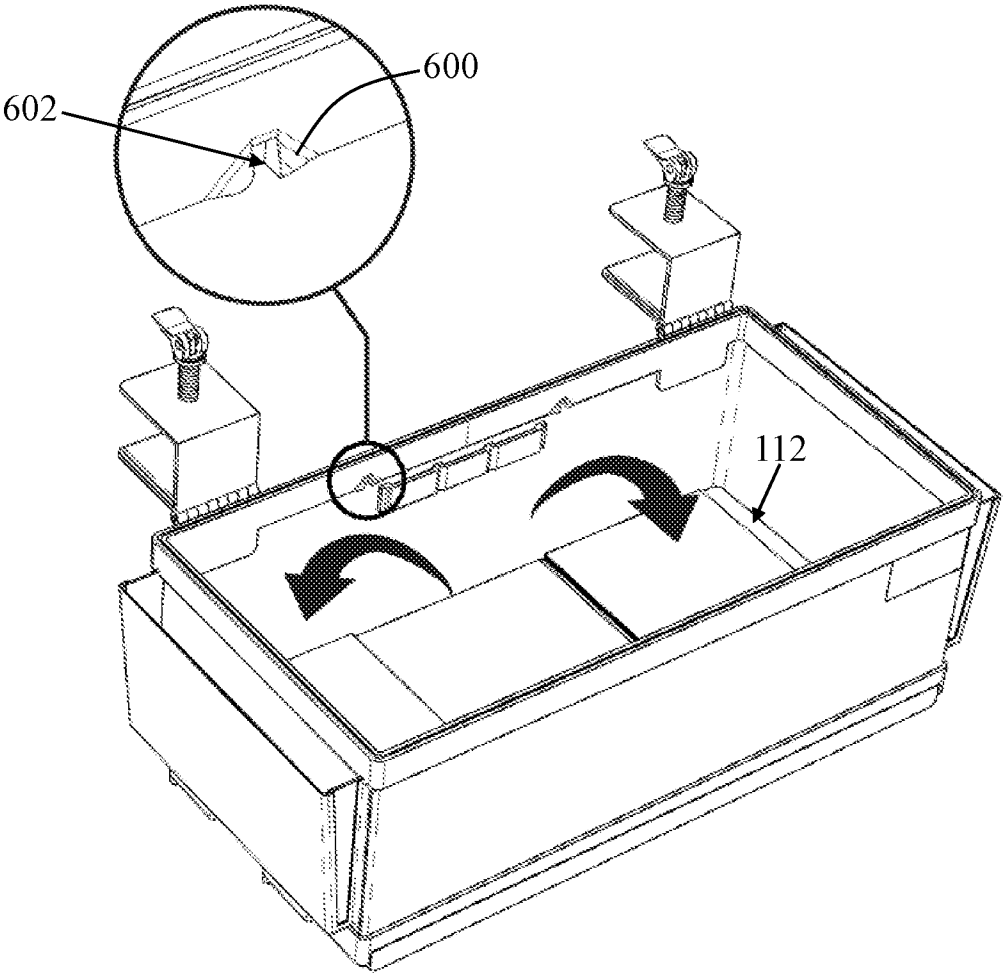
FIG. 6 is an elevated perspective front view of a baby accessory storage assembly in FIG. 1 in accordance with another embodiment of the present invention.

As best seen in FIG. 6, and in other embodiments of this invention, the at least one partition wall 104*a-n*, wherein "n" represents any number greater than one, is selectively collapsible onto a flat position on the bottom wall 112 and can be positioned upright within the storage cavity 122 and locked into place. In one embodiment, one or more partition walls 104*a-n* may be positioned and locked into place with a selectively removable hook-and-loop configuration, e.g., Velcro. In another embodiment of the present invention, the partition walls 104*a-n* may be selectively retained by one or more wall retention members, e.g., member 600, that defines a groove 602 shaped and sized to receive the thickness of the partition walls 104*a-n*. In the alternative, the at least one partition wall 104*a-n* may be removed altogether rather than being placed onto a flat position on the bottom wall 112.

As best seen in FIGS. 1-2, the baby accessory storage assembly 100 may also beneficially include enclosed side pockets 142, 144 defining an upper opening for insertion and removal additional baby accessories. The side pockets 142, 144 may be of an elastic material to enable expansion of the side pockets 142, 144. Further, beneath the side pockets 142, 144, the baby accessory storage assembly 100 may also beneficially include one or more hooks 146, 148 operably configured to selectively rotate from a closed position (FIG. 1) to an open position (FIG. 2). The hooks 146, 148 may have an L-shape to effectively retain and hold baby accessories, e.g., clothing. The hooks 146, 148 are also preferably coupled to the lower rim 140, thereby providing structural stability. The baby accessory storage assembly 100 may also include one or more elastic bands 202*a-n* disposed on the inner surface of the sidewall 114, also enabling retention of various baby accessories, e.g., brushes, thermometers, etc.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A baby accessory storage assembly comprising:

a portable body having a front end, a rear end, two opposing sides, a bottom wall, a sidewall surrounding the bottom wall and having an upper perimeter edge thereon and an inner surface and an outer surface, an upper body rim of a substantially rigid material surrounding and defining the upper perimeter edge of the sidewall, and a lower body rim coupled to the sidewall and disposed proximal to the bottom wall and opposite the upper body rim, the bottom wall and sidewall defining a storage cavity;

at least one partition wall disposed within the storage cavity and with opposing ends are directly coupled to the inner surface of the sidewall to define a plurality of sub-storage cavities; and at least two hinged clamping assemblies each rotatably and directly coupled to the upper body rim of the sidewall, disposed at the rear end of the body, having an upper clamp member with an outer terminal end, and a lower clamp member with an outer terminal end, the upper and lower clamp members:

defining a width channel therein between;

operably configured to selectively adjust a width of the width channel through use of a fastener; and defining a width opening with the outer terminal ends of the upper and lower clamp members, respectively, the at least two hinged clamping assemblies having a first locked position along a clamp translation path with the width opening oriented in a direction facing away from the rear end of the body and a second locked position along the clamp translation path with the width opening oriented a direction facing downwardly and approximately 90° with respect to the width opening when in the first locked position.

2. The baby accessory storage assembly according to claim 1, wherein the at least two hinged clamping assemblies further comprise:

a center wall separating and coupled to the upper and lower clamp members, the center wall and upper and lower clamp members having inner surfaces defining the width channel and forming a U-shape.

3. The baby accessory storage assembly according to claim 2, wherein:

the upper and lower clamp members are substantially planar.

4. The baby accessory storage assembly according to claim 2, wherein the at least two hinged clamping assemblies further comprise:

a deformably resilient material disposed on an inner surface of at least one of the upper clamp member and the lower clamp member.

5. The baby accessory storage assembly according to claim 2, wherein the lower clamp members of the at least two hinged clamping assemblies further comprise:

an outer surface, opposing the inner surface thereon, having a deformably resilient material disposed thereon.

6. The baby accessory storage assembly according to claim 1, wherein:

the clamp translation path is circular.

7. The baby accessory storage assembly according to claim 1, wherein the at least two hinged clamping assemblies further comprise:

a hinge disposed proximal to the upper perimeter edge of the sidewall.

8. The baby accessory storage assembly according to claim 1, wherein:

the sidewall surrounding the bottom wall is of a flexible cloth material.

9. The baby accessory storage assembly according to claim 1, further comprising:

a pull-out table housed within a bottom wall cavity defined by the bottom wall, the pull-out table operably configured to be selectively extended from and retracted in the bottom wall cavity.

10. The baby accessory storage assembly according to claim 1, wherein:

the at least one partition wall is directly coupled to the inner surface of the sidewall with a selectively removable hook-and-loop configuration.

11. The baby accessory storage assembly according to claim 1, wherein:

the at least one partition wall is selectively collapsible onto a flat position on the bottom wall and can be positioned upright within the storage cavity and locked into place by being fitted within a rectangular groove.

12. A baby accessory storage assembly comprising:

a portable body having a front end, a rear end, two opposing sides, a bottom wall having an inner surface and an outer surface, a sidewall surrounding the bottom wall and having an inner surface and an outer surface, an upper body rim of a substantially rigid material surrounding and defining an upper perimeter edge of the sidewall, and a lower body rim coupled to the sidewall and disposed proximal to the bottom wall and opposite the upper body rim, the inner surfaces of the bottom wall and the sidewall defining a storage cavity;

at least one partition wall disposed within the storage cavity and with opposing ends are directly coupled to the inner surface of the sidewall to define a plurality of sub-storage cavities; and at least two hinged clamping assemblies each rotatably coupled to the sidewall, disposed at the rear end of the body, directly coupled to the upper body rim, having an upper clamp member with an outer terminal end, and a lower clamp member with an outer terminal end, the upper and lower clamp members:

defining a width channel therein between;

operably configured to selectively adjust a width of the width channel through use of a fastener; and defining a width opening with the outer terminal ends of the upper and lower clamp members, respectively, the at least two hinged clamping assemblies having a first locked position along a clamp translation path with the width opening oriented in a direction facing away from the rear end of the body and a second locked position along the clamp translation path with the width opening oriented a direction facing downwardly and approximately 90° with respect to the width opening when in the first locked position.

13. The baby accessory storage assembly according to claim 12, wherein:

the sidewall surrounding the bottom wall is of a flexible cloth material.

14. The baby accessory storage assembly according to claim 13, further comprising:

a pull-out table housed within a bottom wall cavity defined by the bottom wall, the pull-out table operably configured to be selectively extended from and retracted in the bottom wall cavity.

15. The baby accessory storage assembly according to claim 12, wherein:

the at least one partition wall is selectively collapsible onto a flat position on the bottom wall and can be positioned upright within the storage cavity and locked into place by being fitted within a rectangular groove.

16. The baby accessory storage assembly according to claim 12, wherein the at least two hinged clamping assemblies further comprise:

a center wall separating and coupled to the upper and lower clamp members, the center wall and upper and lower clamp members having inner surfaces defining the width channel and forming a U-shape.

17. The baby accessory storage assembly according to claim 16, wherein:

the upper and lower clamp members are substantially planar.

18. The baby accessory storage assembly according to claim 17, wherein the at least two hinged clamping assemblies further comprise:

a deformably resilient material disposed on an inner surface of at least one of the upper clamp member and the lower clamp member.

* * * * *